US006989630B2

(12) United States Patent
Kato

(10) Patent No.: US 6,989,630 B2
(45) Date of Patent: Jan. 24, 2006

(54) ELECTRODE FOR ELECTION GUN, METHOD OF MANUFACTURING ELECTRODE FOR ELECTRON GUN, AND ELECTRON GUN ASSEMBLY

(75) Inventor: Yoshihiro Kato, Ibo-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 204 days.

(21) Appl. No.: 10/638,423

(22) Filed: Aug. 12, 2003

(65) Prior Publication Data

US 2004/0095055 A1 May 20, 2004

(30) Foreign Application Priority Data

Aug. 13, 2002 (JP) ..... 2002-236052

(51) Int. Cl.
*H01J 29/02* (2006.01)
*H01J 63/02* (2006.01)

(52) U.S. Cl. ..... 313/452; 313/414; 313/458; 445/46; 445/49; 445/35

(58) Field of Classification Search ..... 313/409–417, 313/441–460; 445/49, 35
See application file for complete search history.

(56) References Cited

U.S. PATENT DOCUMENTS 4,185,223 A * 1/1980 Anezaki ..... 313/446
4,919,634 A * 4/1990 Ito et al. ..... 445/49

FOREIGN PATENT DOCUMENTS

JP 64-43952 2/1989

* cited by examiner

*Primary Examiner*—Mariceli Santiago
(74) *Attorney, Agent, or Firm*—Oblon, Spivak, McClelland, Maier & Neustadt, P.C.

(57) ABSTRACT

A surface of a first grid electrode, which is located on a cathode side and is one of a plurality of electrodes for an electron gun used in an electrode gun assembly, is formed to be a rough surface having a higher degree of surface roughness than a surface of a second grid electrode located adjacent to the first grid electrode.

15 Claims, 2 Drawing Sheets

ELECTRODE FOR ELECTION GUN, METHOD OF MANUFACTURING ELECTRODE FOR ELECTRON GUN, AND ELECTRON GUN ASSEMBLY

CROSS-REFERENCE TO RELATED APPLICATIONS

This application is based upon and claims the benefit of priority from the prior Japanese Patent Application No. 2002-236052, filed Aug. 13, 2002, the entire contents of which are incorporated herein by reference.

BACKGROUND OF THE INVENTION

1. Field of the Invention

The present invention relates generally to an electrode for an electron gun, a method of manufacturing an electrode for an electron gun, and an electron gun assembly. In particular, this invention relates to an electrode for an electron gun, which is applicable as a first grid electrode of an electron gun assembly, a method of manufacturing the electrode for the electron gun, and an electron gun assembly including the electrode for the electron gun.

2. Description of the Related Art

In the prior art, as described in Jpn. Pat. Appln. KOKAI Publication No. 64-43952, for instance, an electron gun assembly applied to a cathode-ray tube is configured to include a cathode that emits electrons, and a plurality of electron gun electrodes disposed coaxial with the cathode.

In this type of electron gun assembly, while it is being operated, barium oxide (BaO), which is an electron emission substance of the cathode, is reduced with the emission of electrons. As a result, barium (Ba) is evaporated from the cathode. Most of the evaporated barium (Ba) tends to easily deposit on a first grid electrode, which is one of a plurality of electron gun electrodes and is disposed near the cathode.

In an electron gun assembly described in Jpn. Pat. Appln. KOKAI Publication No. 64-43952, it is intended to positively remove the deposited barium (Ba) by a reduction action of a metal coat film formed on a surface of the first grid electrode. However, the metal coat film is easily oxidized in the manufacturing process of the cathode-ray tube and thus the metal coat film cannot fully function. Consequently, a barium film may easily deposit on the surface of the first grid electrode.

If a barium (Ba) film deposits on the surface of the first grid electrode with the passing of operation time, as mentioned above, the barium film may possibly remove and drop from the first grid electrode due to various factors such as vibration. The removed barium film may short-circuit the first grid electrode and the cathode, or the first grid electrode and the second grid electrode. Hence, the performance of the electron gun assembly may deteriorate, or a fault may occur in the electron gun assembly, which leads to degradation in reliability.

BRIEF SUMMARY OF THE INVENTION

The present invention has been made to solve the above problem, and the object of the invention is to provide an electrode for an electron gun, a method of manufacturing an electrode for an electron gun, and an electron gun assembly, which have an improved reliability.

According to a first aspect of the invention, there is provided an electrode for an electron gun, which is a first grid electrode located on a cathode side, the first grid electrode being one of a plurality of electrodes for the electron gun used in an electrode gun assembly, wherein a surface of the first grid electrode is formed to be a rough surface having a higher degree of surface roughness than a surface of a second grid electrode located adjacent to the first grid electrode.

According to a second aspect of the invention, there is provided a method of manufacturing an electrode for an electron gun, which is a first grid electrode located on a cathode side, the first grid electrode being one of a plurality of electrodes for the electron gun used in an electrode gun assembly, wherein a surface of the first grid electrode is formed to be a rough surface having a higher degree of surface roughness than a surface of a second grid electrode located adjacent to the first grid electrode.

According to a third aspect of the invention, there is provided an electron gun assembly having an electron beam generating section that generates an electron beam, wherein the electron beam generating section comprises a cathode, a first grid electrode located on the cathode side, and a second grid electrode located adjacent to the first grid electrode, and a surface of the first grid electrode is formed to be a rough surface having a higher degree of surface roughness than a surface of the second grid electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of an electrode for an electron gun, a method of manufacturing an electrode for an electron gun, and an electron gun assembly, according to the present invention, will now be described in detail with reference to the accompanying drawings.

Figure 1:
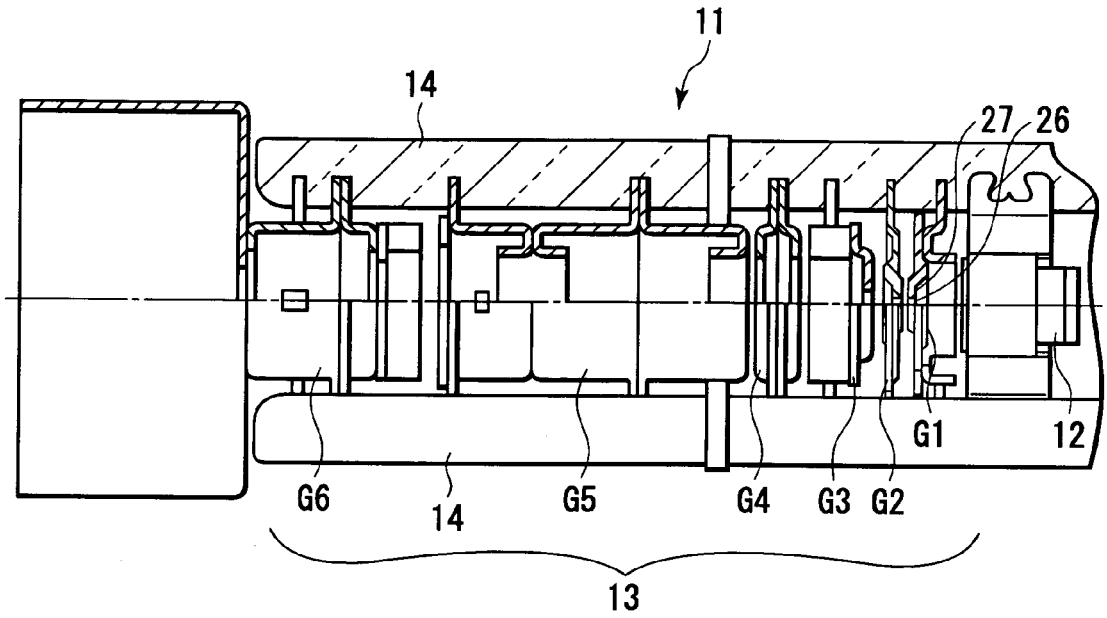
FIG. 1 is a partial cross-sectional view schematically showing the structure of an electron gun assembly according to an embodiment of the present invention.

As is shown in FIG. 1, an electron gun assembly 11 that is applicable to a cathode-ray tube comprises a cathode 12 that can emit electrons, a plurality of electron gun electrodes 13 disposed in succession on the same axis at regular intervals, relative to the cathode 12, and a pair of bead glasses 14 that hold and integrally fix implant portions of the cathode 12 and the plural electron gun electrodes 13.

The cathode 12 is formed such that void portions of porous tungsten with a void ratio of, e.g. about 20% are impregnated, in a high-temperature hydrogen atmosphere, with molten electron emission substances of barium oxide (BaO), calcium oxide (CaO) and aluminum oxide ($Al_2O_3$). The mole composition ratio of the electron emission substances of the cathode 12 is $BaO:CaO:Al_2O_3=4:1:1$. An iridium (Ir) film having a thickness of 0.2 $\mu$m is coated on the surface of the cathode 12 with this structure.

The plural electron gun electrodes 13 comprise a first grid electrode G1, a second grid electrode G2, a third grid electrode G3, a fourth grid electrode G4, a fifth grid electrode G5 and a sixth grid electrode G6, which are arranged in the named order from the cathode 12 side. The bead glass 14 is formed of an insulating material. Each bead glass 14 is a rod extending in the axial direction. Implant portions provided on the cathode 12 and on each electron gun electrode 13 are embedded in the pair of bead glasses 14.

The electron gun assembly 11 with the above structure includes an electron beam generating section and an electron lens section that are composed of the electron gun electrodes, to which predetermined voltages are applied. For example, the cathode 12, first grid electrode G1 and second grid electrode G2 constitute the electron beam generating section that generates electron beams.

Figure 2:
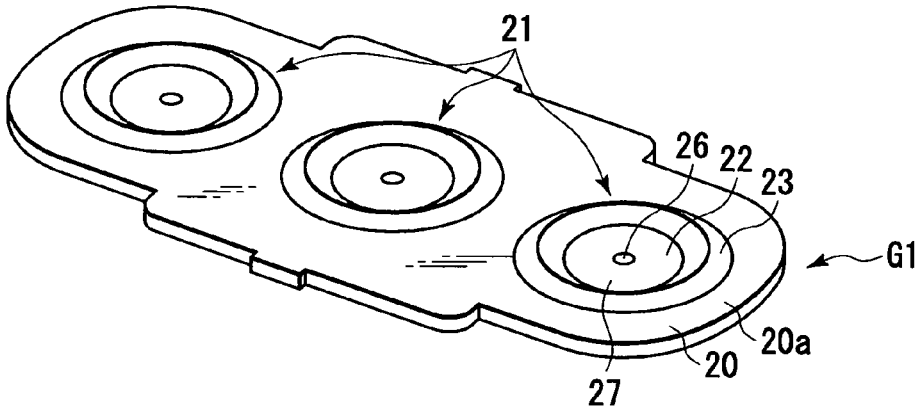
FIG. 2 is a perspective view schematically showing the structure of a first grid electrode shown in FIG. 1, the first grid electrode being viewed from the cathode side.
Figure 3:
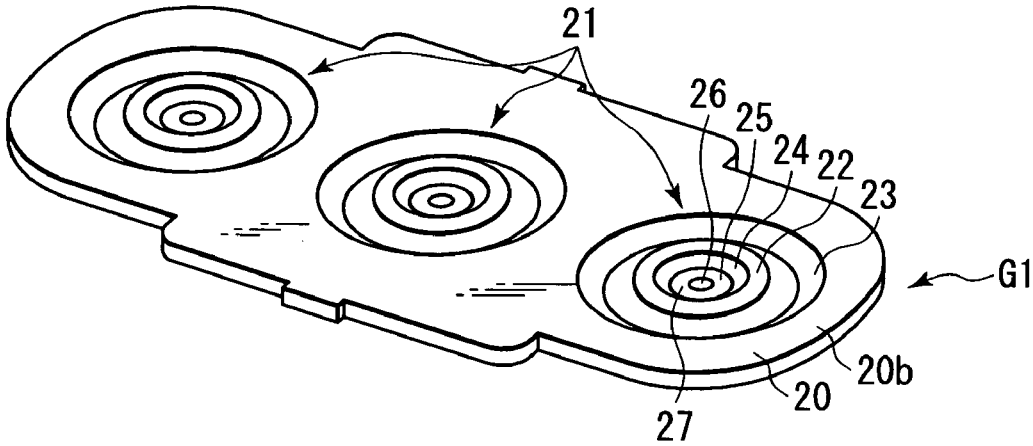
FIG. 3 is a perspective view schematically showing the structure of the first grid electrode shown in FIG. 1, the first grid electrode being viewed from the second grid electrode side (the side opposite to the cathode)
Figure 4:
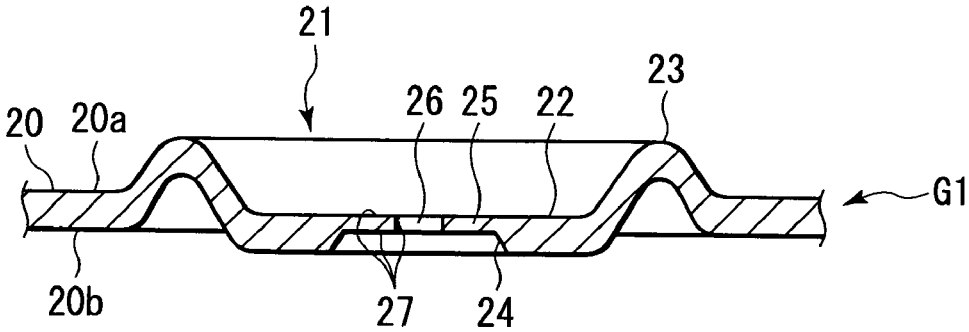
FIG. 4 is a cross-sectional view schematically showing the structure of the first grid electrode shown in FIG. 1.

As is shown in FIGS. 2 to 4, the electron gun electrode applicable as the first grid electrode G1 is formed by pressing a thin material metal plate 20 with a thickness of about 0.15 mm to 0.25 mm, which is formed of, e.g. stainless steel, Kovar alloy, or nickel-iron alloy. The electron gun electrode G1 has three beam passage portions 21 at locations corresponding to positions where red, blue and green electron beams travel in order to reproduce a color image.

Each beam passage portion 21 has a coin portion 22 and a bead portion 23. The coin portion 22 has a flat circular shape on a first major surface 20*a* of the metal plate 20, which faces the cathode 12. The bead portion 23 has an annular shape surrounding the coin portion 22. The bead portion 23 has a ridge-like shape on the first major surface 20*a*, and projects toward the cathode 12.

The coin portion 22 has a circular recess portion 24 in a second major surface 20*b* of the metal plate 20, which faces the second grid electrode G2. The recess portion 24 is formed by thinning the material metal plate 20. Specifically, the recess portion 24 has, as a bottom portion, a thin circular portion 25 with a thickness of about 0.06 mm to 0.08 mm. The thin circular portion 25 has a beam passage hole 26 formed at a substantially central portion thereof, which permits passage of the associated electron beam.

The surface of the first grid electrode G1 is formed as a rough surface 27 having a higher surface roughness than, at least, the surface of the second grid electrode G2 that is adjacent to the first grid electrode G1. The rough surface 27 is formed on the entire first grid electrode G1 or on at least a peripheral portion of the beam passage hole 26.

The peripheral portion of the beam passage hole 26, in this context, includes an inner peripheral surface of the beam passage hole 26, the first major surface 20*a* facing the cathode 12, and the second major surface 20*b* located on the side opposite to the cathode 12 side. The reason why at least the peripheral portion of the beam passage hole 26 is formed of the rough surface 27 is that evaporated matter, which is evaporated from the cathode 12 and deposits on the first grid electrode G1, concentrates at the peripheral portion of the beam passage hole 26.

It is preferable that the surface roughness Rz of the rough surface 27 be in a range of 0.2 $\mu$m to 1.5 $\mu$m. If the surface roughness Rz is less than 0.2 $\mu$m, the degree of unevenness of the surface of the metal plate 20 is too low to attain a sufficient strength of bonding with evaporated matter. If the surface roughness Rz is greater than 1.5 $\mu$m, the degree of unevenness of the surface of the metal plate 20 is high enough to attain a sufficient strength of bonding with evaporated matter, but the degree of unevenness is so high that unnecessary electron emission may easily be induced by the potential of the first grid electrode G1. Consequently, even after the cathode-ray tube is switched off, the screen is not completely turned off and the screen would remain partly luminous. Besides, the rough surface 27 looks as if it were scarred, which is not preferable in terms of external appearance.

The rough surface 27 is formed by a surface reforming process that reforms the surface condition of the material metal plate 20. The surface reforming process is not limited if it can set the surface roughness of a desired location on the metal plate 20 within the above-mentioned range. Examples of the surface reforming process include etching by chemical polishing using an acid, etching by reverse-sputtering in a film forming unit, and an air-baking process that oxidizes the surface of the metal plate 20 by baking it in air. These processes roughen the surface of the metal plate 20 by forming air bubbles thereon.

According to the cathode-ray tube including the electron gun assembly with the above structure, while it is being operated, barium oxide (BaO), which is an electron emission substance of the cathode 12, is reduced with the emission of electrons. As a result, barium (Ba) is evaporated from the cathode 12. Most of the evaporated barium (Ba) deposits on the first grid electrode G1, which is one of the electron gun electrodes 13 and is disposed near the cathode, and it particularly deposits on the peripheral portion of the beam passage hole 26. The barium (Ba), or the evaporated matter, deposits in the form of a film on the periphery of the beam passage hole 26 with the passing of operation time.

At least the peripheral portion of the beam passage hole 26 of the first grid electrode G1 is formed as the rough surface 27. The rough surface 27 has a high degree of unevenness and has an increased contact area with the deposited barium film. In addition, since the uneven area of the rough surface 27 serves as "wedge", the strength of bonding between the rough surface 27 of first grid electrode G1 and the deposited barium film is increased. Hence, even if various factors such as vibration occur, it is less possible that the deposited barium film removes and drops from the first grid electrode G1. Accordingly, it is possible to suppress the occurrence of short-circuit due to the removed barium film between the cathode 12 and the first grid electrode G1 or between the first grid electrode G1 and the second grid electrode G2. Therefore, it is possible to prevent deterioration in the performance of the electron gun assembly, or a fault occurring in the electron gun assembly. The reliability of the electron gun assembly is thus enhanced.

The surface roughness Rz of the rough surface 27 is set in the range of 0.2 $\mu$m to 1.5 $\mu$m. Thereby, it is possible to attain a sufficient strength of bonding between the rough surface 27 and the barium film deposited on the rough surface 27, and to suppress unnecessary electron emission due to an excessively high degree of surface roughness. The surface roughness can be properly set to achieve these two features.

The rough surface 27 is formed by reforming the surface condition of the material metal plate 20. It is thus possible to easily create the uneven shape that can achieve the sufficient strength of bonding with the deposited barium film.

There is another method of forming the rough surface 27 on the first grid electrode G1, wherein the surface of the material (metal plate) 20 is provided with unevenness (roughness) by rolling the material 20 with a roller with unevenness. However, since the coin portion 22 and thin (recess) portion 24 are formed by pressing the material 20, the surface unevenness may easily be flattened. Thus, the rough surface 27 can be formed more exactly by the method in which the surface reforming process is performed after pressing the material 20 into the shape of the first grid electrode G1.

As has been described above, according to the present invention, the surface of one of the plural electron gun electrodes, which is located closest to the cathode, that is, the surface of the first grid electrode, is formed to have a rough surface with a higher surface roughness than the surface of the electron gun electrode located adjacent to the first grid electrode, that is, the second grid electrode. Therefore, the strength of bonding between the rough surface of the first grid electrode and the deposit matter, which is evaporated from the cathode and deposits on the rough surface of the first grid electrode, can be increased, and the possibility of removal of the deposit matter can be decreased. Accordingly, deterioration of the performance of the electron gun assembly and the occurrence of fault of the electron gun assembly can be prevented, and the reliability is enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrode for an electron gun, which is a first grid electrode located on a cathode side, the first grid electrode being one of a plurality of electrodes for the electron gun used in an electrode gun assembly, wherein a surface of the first grid electrode is formed to be a rough surface having a higher degree of surface roughness than a surface of a second grid electrode located adjacent to the first grid electrode.

2. The electrode for an electron gun according to claim 1, wherein the first grid electrode has a beam passage hole, and at least a peripheral portion of the beam passage hole is formed to be a rough surface.

3. The electrode for an electron gun according to claim 1, wherein the degree of surface roughness of the first grid electrode is higher than the degree of surface roughness of the second grid electrode.

4. The electrode for an electron gun according to claim 3, wherein the surface roughness (Rz) of the first grid electrode is in a range of 0.2 $\mu$m to 1.5 $\mu$m.

5. The electrode for an electron gun according to claim 1, wherein the rough surface of the first grid electrode is formed by a surface reforming process.

6. A method of manufacturing an electrode for an electron gun, which is a first grid electrode located on a cathode side, the first grid electrode being one of a plurality of electrodes for the electron gun used in an electrode gun assembly, wherein a surface of the first grid electrode is formed to be a rough surface having a higher degree of surface roughness than a surface of a second grid electrode located adjacent to the first grid electrode.

7. The method of manufacturing an electrode for an electron gun according to claim 6, wherein at least a peripheral portion of a beam passage hole provided in the first grid electrode is formed to be a rough surface.

8. The method of manufacturing an electrode for an electron gun according to claim 6, wherein the degree of surface roughness of the first grid electrode is made higher than the degree of surface roughness of the second grid electrode.

9. The method of manufacturing an electrode for an electron gun according to claim 8, wherein the surface roughness (Rz) of the first grid electrode is set in a range of 0.2 $\mu$m to 1.5 $\mu$m.

10. The method of manufacturing an electrode for an electron gun according to claim 6, wherein the rough surface of the first grid electrode is formed by a surface reforming process.

11. An electron gun assembly having an electron beam generating section that generates an electron beam, wherein the electron beam generating section comprises a cathode, a first grid electrode located on the cathode side, and a second grid electrode located adjacent to the first grid electrode, and a surface of the first grid electrode is formed to be a rough surface having a higher degree of surface roughness than a surface of the second grid electrode.

12. The electron gun assembly according to claim 11, wherein the first grid electrode has a beam passage hole, and at least a peripheral portion of the beam passage hole is formed to be a rough surface.

13. The electron gun assembly according to claim 11, wherein the degree of surface roughness of the first grid electrode is higher than the degree of surface roughness of the second grid electrode.

14. The electron gun assembly according to claim 13, wherein the surface roughness (Rz) of the first grid electrode is in a range of 0.2 $\mu$m to 1.5 $\mu$m.

15. The electron gun assembly according to claim 11, wherein the rough surface of the first grid electrode is formed by a surface reforming process.

* * * * *